United States Patent [19]

Kumata

[11] Patent Number: 4,793,766

[45] Date of Patent: Dec. 27, 1988

[54] REGENERATIVE FUEL PUMP HAVING MEANS FOR REMOVING FUEL VAPOR

[75] Inventor: Hirotaka Kumata, Saitama, Japan

[73] Assignee: Honda Giken Kogyo Kabushiki Kaisha, Japan

[21] Appl. No.: 163,626

[22] Filed: Mar. 3, 1988

[30] Foreign Application Priority Data

Mar. 12, 1987 [JP] Japan ..... 62-57614

[51] Int. Cl.[4] ..... F04D 9/00

[52] U.S. Cl. ..... 415/53 T; 415/168; 417/366

[58] Field of Search ..... 415/53 T, 121 A, 168, 415/198.2, 213 T; 417/366

[56] References Cited

U.S. PATENT DOCUMENTS

| | | | |
|---|---|---|---|
| 3,418,991 | 12/1968 | Schultz et al. | 417/366 X |
| 3,881,839 | 5/1975 | MacManus | 415/168 X |
| 3,982,848 | 9/1976 | Schonwald et al. | 415/53 T |
| 4,508,492 | 4/1985 | Kusakawa et al. | 417/366 |
| 4,538,958 | 9/1985 | Takei et al. | 415/53 T |
| 4,653,979 | 3/1987 | Schillinger | 415/168 X |
| 4,692,092 | 9/1987 | Matsuda et al. | 417/366 X |

FOREIGN PATENT DOCUMENTS

| | | |
|---|---|---|
| 46-26443 | 7/1971 | Japan . |
| 60-79193 | 5/1985 | Japan . |

*Primary Examiner*—Robert E. Garrett
*Assistant Examiner*—Joseph M. Pitko
*Attorney, Agent, or Firm*—Steele, Gould & Fried

[57] ABSTRACT

A regenerative fuel pump, comprising: a disc-shaped pump rotor having a plurality of vanes along its periphery; a pump housing accommodating the pump rotor; a fluid inlet port provided in the pump housing along a longitudinal direction; an arcuate fuel passage extending in the pump housing from the inlet port along the periphery of the pump rotor; a fluid outlet port communicating with a terminal end of the arcuate fuel passage; and a slot extending from the inlet port a certain distance into the arcuate fuel passage along an inner circumferential region thereof; the slot extending longitudinally from the arcuate fuel passage to pump exterior through a substantially straight path and circumferentially through a tortuous path. Preferably, the slot is defined by a separate member which is fitted into a recess provided in the pump housing. Thus, the vapor contained in the fuel is separated from the liquid part of the fuel in the longitudinal direction encountering very little resistance while the effective length of the arcuate fuel passage is not reduced because of the tortuous path along the circumferential direction and the vapor is removed from the slot before it is substantially compressed with the result that the vapor is effectively removed from the fuel without substantially impairing the pump efficiency.

8 Claims, 4 Drawing Sheets

REGENERATIVE FUEL PUMP HAVING MEANS FOR REMOVING FUEL VAPOR

TECHNICAL FIELD

The present invention relates to a regenerative fuel pump which is equipped with means for removing the vapor content from the fuel and is therefore free from the problems arising from the vaporization of the fuel.

BACKGROUND OF THE INVENTION

In modern automotive engines, regenerative pumps are being used for their fuel pumps in an increased number not only because of their compactness in size but also because of their favorable properties to produce high pressure heads and low flow rates. In a pump of this structure, in particular, a pump which is sometimes referred to as peripheral type because the pump rotor thereof consists of a disc having a plurality of vanes along its periphery, since the fuel inlet is relatively small and the fuel is introduced perpendicularly in relation to the outlet passage, the vapor tends to be separated from the fuel and cavitation tends to occur with the result that the vapor locking takes place and the efficiency of the pump is severely impaired.

Therefore, a number of proposals have been made in the past to remove vapor from the fuel inlet of a pump of this type. For instance, Japanese Patent Publication No. 46-26443 which corresponds to U.S. patent application No. 645,150 filed June 12, 1967 discloses a vent hole (denoted with numeral 86) provided in the arcuate passage defined alnng the pump wheel of a peripheral type pump. The vent hole is located adjacent to the root end portions of the vanes of the pump wheel and is preferred to be located at a relatively upper part of the pump when the pump is in use for effective removal of vapor from the fuel.

In Japanese Patent Laid-Open Publication No. 60-79193 which also discloses a regenerative fuel pump, the arcuate fuel passage which is defined along the oute periphery of the pump rotor is broadened at its portion adjacent to the inlet port of the fuel pump and a vapor vent opening is provided at a terminal end of this broadened part of the fuelppassage. The vapor contained in the fuel is separated from the liquid part of the fuel by the centrifgal force as the fuel flows through this broadened passage. However, since the effective length of the fuel passage which is defined along the outer periphery of the pump rotor is reduced by the length of the broadened passage, the pressure head of the pump is reduced. Also, since the vapor vent opening is provided at a location which is a certain distance from the inlet port, the vapor is compressed before it is released from the vent opening. Therefore, the pump work is wasted because of this compression of the vapor and the efficiency of the pump is thus impaired.

BRIEF SUMMARY OF THE PRESENT INVENTION

In view of these problems of the prior art, a primary object of the present invention is to provide a fuel pump which is provided with means for removing fuel vapor from liquid fuel without substantially compromising the pressure head and the efficiency of the pump.

These and other objects of the present invention can be accomplished by providing a regenerative fuel pump, comprising: a pump rotor having a plurality of vanes along its periphery; a pump housing accommodating the pump rotor in a rotatable manner; a fluid inlet port provided in the pump housing along a longitudinal direction; an arcuate fuel passage extending from the inlet port along the periphery of the pump rotor; a fluid outlet port communicating with a terminal end of thearcuate fuel passage; and a slot extending in the pump housing from the inlet port a certain distance into the arcuate fuel passage along an inner circumferential region thereof; the slot extending longitudinally from the arcuate fuel passage to pump exterior through a narrow path and circumferentially through a tortuous path.

Since the vapor contained in the fuel is separated from the liquid part of the fuel at a location adjacent to the inlet end of the fuel passage defined along the outer periphery of the pump rotor, the effective length of the fuel passage is not reduced and the vapor is removed from the slot before it is substantially compressed.

Preferably, the slot is defined by a U-shaped member which is fitted into a recess provided in the pump housing. Thus, the manufacturing rrocess of the pump housing is simplified and the configuration of the narrow longitudinal path and the tortuous longitudinal path can be readily adjusted simply by replacing this U-shaped member for optimum results.

According to a certain embodiment of the present invention, the U-shaped member is provided with a pair of legs which define the slot therebetween, at least one of inner surfaces of the legs being provided with a shape of battlement so as to define the circumferential tortuous path. This battlement may define a plurality of ridges extending longitudinally which are either straight along the longitudinal direction or inclined in relation with the longitudinal line. Further, the U-shaped member is provided with a pair of flanges at end portions of the legs of the U-shaped member, the flanges defining a part of a wall surface of the inlet port of the pump.

The recess may extend either all the way from the arcuate fuel passage to the pump exterior or short of the pump exterior. In the latter case, a hole may extend from the recess totthe pump exterior, with a shoulder surface defined between the hole and the recess for receiving the U-shaped member.

DETAILED DESCRIPTION OF THE PREFERRED EMBODIMENTS

Figure 1:
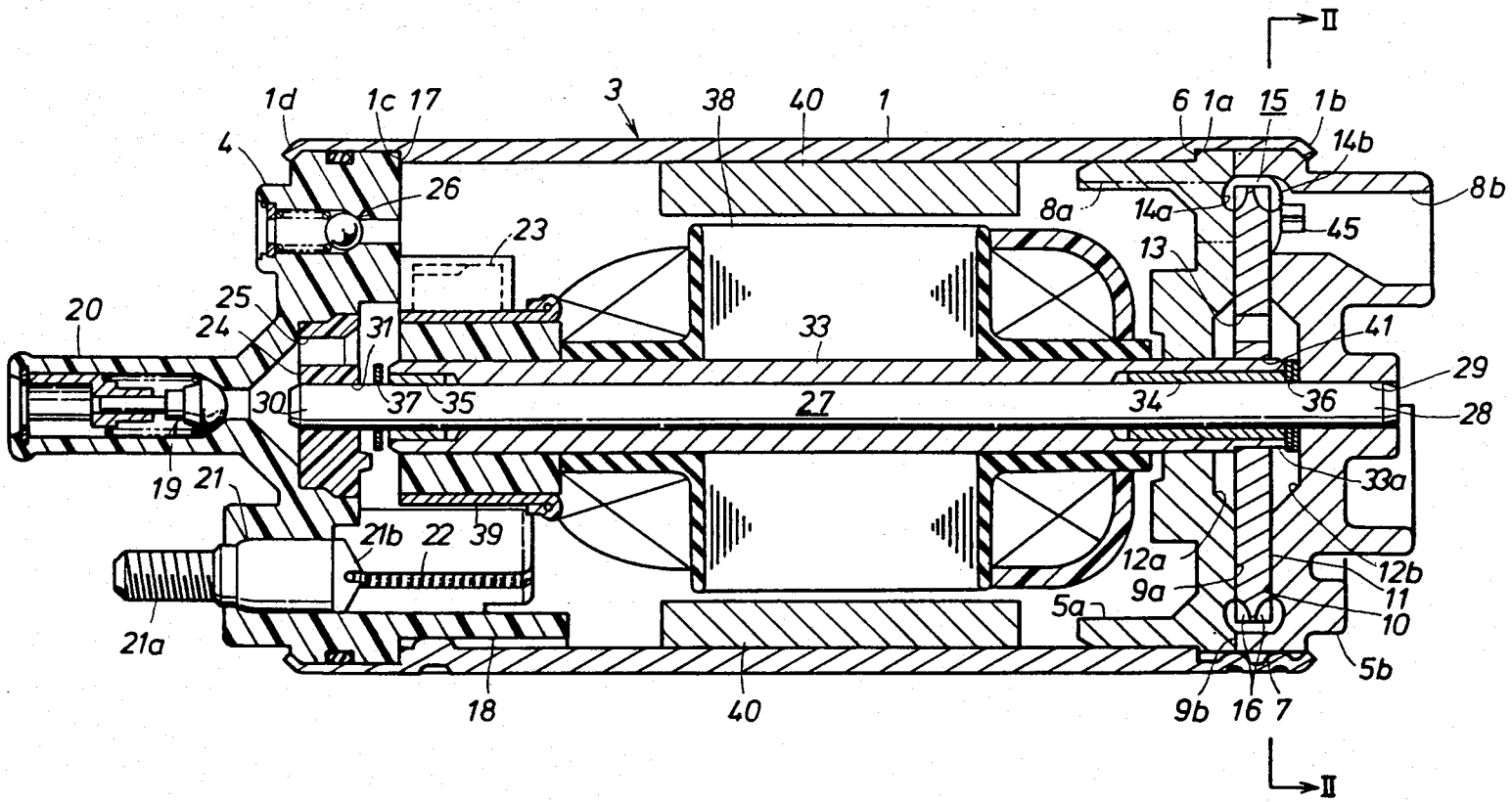
FIG. 1 is a sectional view of a fuel pump assembly to which an embodiment of the present invention is applied.

FIG. 1 generally shows a fuel pump assembly according to the present invention. This fuel pump assembly is adapted to be placed adjacent to the bottom panel of a fuel tank, immersed in the fuel, and comprises a pump unit 2 received in one end portion of a cylindrical casing 1, a motor unit 3 received in a middle part of the casing 1 and a terminal holder 4 provided at the other end portion of the casing 1.

The pump unit 2 is provided with a pumphhousing 5 consisting of an inner half 5*a* and an outer half 5*b* which are securely fixed at their peripheral portions 6 by being interposed between an annular shoulder surface 1*a* provided in the inner circumferential surface of the casing 1 and the outer most end 1*b* of the casing 1 which is reduced in thickness and crimped inward against a peripheral portion of the pump housing outer half 5*b*. The outer circumferential surface of the pump housing 5 is provided with a notch 7 extending longitudinally and the outer most end of the casing 1 is also crimped into this notch 7 to prevent a relative rotation between the pump housing 5 and the casing 1.

The pump housing outer half 5*b* is provided with a longitudinal fuel inlet 8*b* at a peripheral portion thereof. The inner face 9*b* of the pump housing outer half 5*b* opposing the pump housing inner half 5*a* is provided with a coaxial circular recess 10 which defines a generally disc-shaped chamber in cooperation with the opposing face of the pump housing inner half 5*b* to accommodate therein a pump rotor 11. The central portions of the recess 10 of the pump housing outer half 5*b* and the face of the pump housing inner half 5*a* opposing the recess 10 are provided with further recesses 12*b* and 12*a*, respectively, which are smaller than the previously mentioned recess 10 and are mutually communicated by way of a longitudinal through hole 13 provided in the pump rotor 11.

The peripheral regions of the primary recess 10 and the corresponding part of the opposing face 9*a* of the pump housing inner half 5*a* are provided with annular grooves 14*b* and 14*a*, respectively, and these grooves 14*a* and 14*b* extend almost along the whole circumferential length of the circular primary recess 10 and jointly define an arcuate fuel passage 15 which is almost annular. The both surfaces of the peripheral region of the pump rotor 11 is provided with a plurality of vanes 16 by forming a plurality of recesses 16*a* along both the peripheral regions of the major surfaces of the pump rotor 11 at equal interval. The longitudinal fuel inlet 8*b* of the pump housing outer half 5*b* is connected to an end of this arcuate fuel passage 15 while the other end of the arcuate fuel passage 15 is communicated with the interior of the casing 1 by way of a longitudinal through hole 8*a* provided in the pump housing inner half 5*a*. Thus, as the pump rotor 11 rotates, the fuel is introduced into the interior of the casing 1 by way of the longitudinal fuel inlet 8*b*, the arcuate fuel passage 15 and the longitudinal through hole 8*a* of the pump housing inner half 5*a*.

The terminal holder 4 is disc-shaped and is likewise interposed at its peripheral region 17 between an annular shoulder surface 1*c* provided in the inner circumferential surface of the casing 1 and the outer most end 1*d* of the casing 1 which is reduced in thickness and is crimped inward against the peripheral region of the terminal holder 4. A longitudinal internal extension of the terminal holder 4 is provided with a longitudinal notch 18 into which a part of the casing 1 is crimped for preventing a relative rotation between the terminal holder 4 and the casing 1.

A fuel outlet tube 20 having a one-way valve 19 therein integrally projects longitudinally an outwardly from a central part of the terminal holder 4. A pair of terminal pieces 21 are insert molded with the terminal holder 4 and each of the terminal pieces 21 is provided with an external end 21*a* which is threaded so as to be connected to an external circuit and an internal end 21*b* which is connected to one of a pair of brushes 23, which may be made of graphite, by way of a choke coil 22 and so on. A support piece 24 made of synthetic resin material is fitted into a central recess provided in an internal surface of the terminal holder 4. This support piece 24 supports an end 30 of a fixed shaft 27 at its central hole 31 and is additionally provided with a longitudnnal through hole 25 for communicating the fuel outeet tube 20 with the interior of the casing 1. The terminal holder 4 is further provided with a relief valve 26 for relieving any excess pressure which might be produced inside the casing 1.

The other end 28 of the fixed shaft 27 is fitted into a central hole 29 of the pump housing outer half 5*b*. A hollow rotary shaft 33 is fitted over the fixed shaft 27 by way of a pair of cylondrical bushes 35 and 36 interposed therebetween adjacent to their end portions. Thrust washers 36 and 37 are fitted over the fixed shaft 27 so as to be interposed between one of the outer most ends of the rotary hollow shaft 33 and the pump housing outer half 5*b* and between the other outer most end of the hollow rotary shaft 33 and the support piece 27, respectively. A middle part of the hollow rotary shaft 33 carries an armature 38 of an electric motor comprising a core consisting of a plurality of steel plates which are stacked up one over the other and windings formed on this core, and a commutator 39 which are electrically connected to the windings in a known manner. A pair of semi-cylindrical permanent magnet pieces 40 are attached to the inner circumferential surface of the casing 1 opposite to the armature 38.

The pump unit end 33*a* of the hollow rotary shaft. 33 is provided with aD-shaped cross section and is fitted into a complementary central hole 41 provided in the pump rotor 11. Thus, the pump rotor 11 integrally rotates with the hollow rotary shaft 33 while there is provided a certain freedom in the longitudinal relative motion therebetween.

Figure 2:
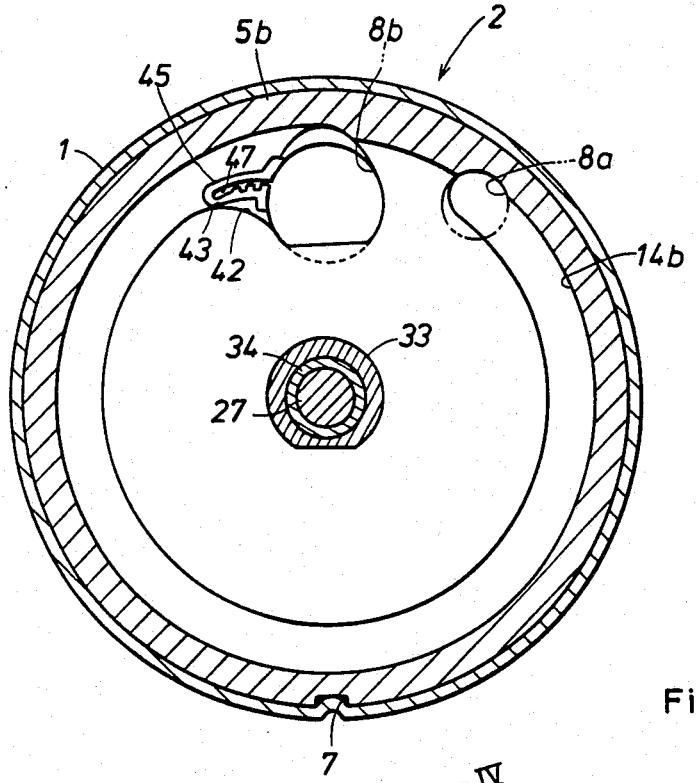
FIG. 2 is a sectional view taken along line II—II of FIG. 1.
Figure 3:
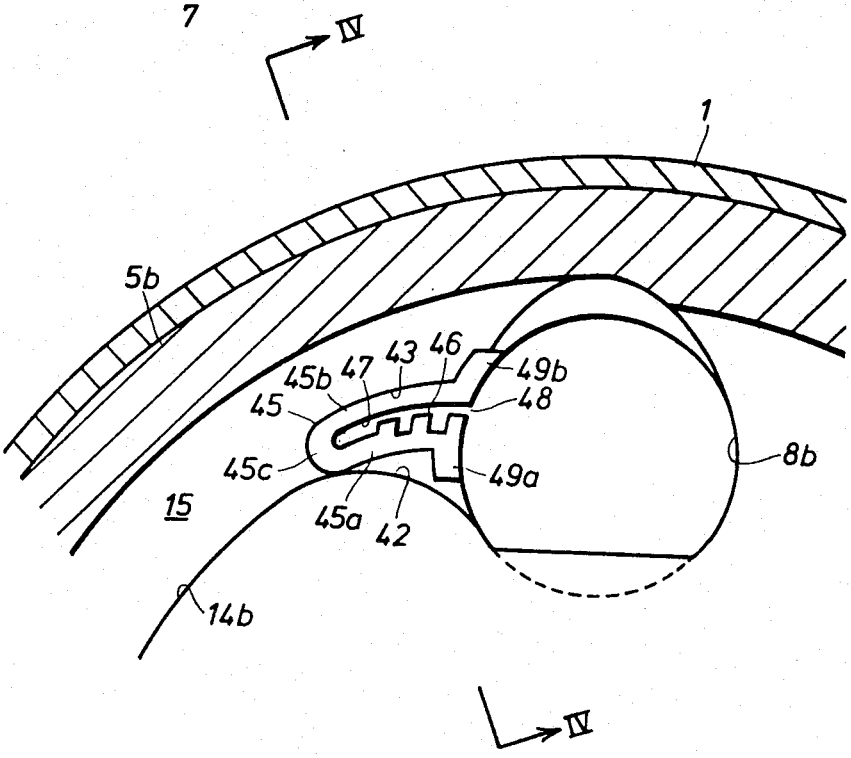
FIG. 3 is a magnifie view of a part of FIG. 2.
Figure 4:
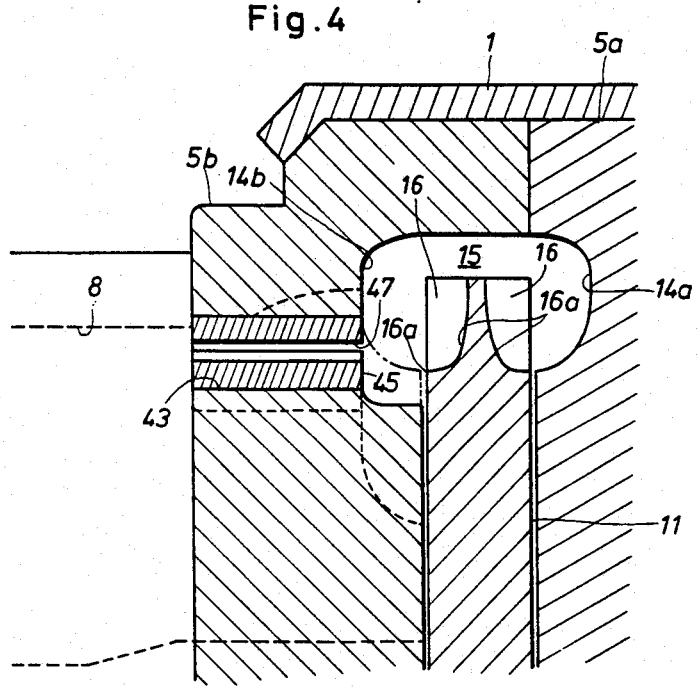
FIG. 4 is a sectional view taken along line IV—IV of FIG. 3.

As best shown in FIG. 2, the arcuate groove 14*b* provided in the recess 10 of the pump housing outer half 5*b* is slightly broadened adjacent to its inlet end which directly communicates with the fuel inlet port 8*b*. Further, this broadened inlet portion 42 is provided with a recess 43 which communicates with the outside of the pump unit 2 and extends a certain distance into the arcuate fuel passage 15 and a labyrinth member 45 is press fitted into this recess 43 as shown in FIGS. 3 and 4.

The recess 43 extends from the inner wall surface of the fuel inlet port 8*b* longitudinally completely through the pump housing outer half 5*b*. The labyrinth member 45 is made of either synthetic resin material or metallic material and is substantially U-shaped, having a pair of legs 45*a* and 45*b* which are joined by a portion 45*c*, thus defining a slot 47 between the two legs 45*a* and 45*b*. At least one of the mutually opposing inner surfaces 46 of the two legs 45*a* and 45*b* of the labyrinth member 45 is provided with the shape of a battlement defining a tortuous path or a labyrinth passage between the mutually opposing inner surfaces of the legs 45*a* and 45*b*. This battlement is defined by a plurality of ridges 46*a* which extend longitudinally.

The other ends of legs 45*a* and 45*b* of the labyrinth member 45 are each provided with a flange 49*a* and 49*b* which extends laterally and outwardly and is fitted into a recess provided in the wall surface of the fuel inlet port 8*b* so that the external surfaces of the flange 49*a* and 49*b* present a generally continuous or flush surface in relation with the adjoining wall surface of the fuel inlet port 8*b*. Thus, a part of the fuel passage 15 extending a certain distance away from the inlet port 8*b* is communicated with the outside of the pump assembly longitudinally through the narrow slot 47 or so as to negate the effect of the labyrinth passage and with the inlet port 8*b* by way of the narrow slot 47 along the circumferential direction or so as to produce the full effect of the labyrinth passage.

When the pump rotor 11 is rotating by being driven by the motor unit 3, the fuel which may contain vapor is introduced into the fuel passage 15 by way of the fuel inlet port 8*b*. As the fuel flows along the arcuate fuel passage 15, its liquid part is urged radially outwardly while its vapor content is urged radially inwardly due to the centrifugal force acting upon the fuel. There is a slight pressure gradient along the fuel passage 15 due to the rotation of the pump rotor 11 and, since the narrow slot 47 extends along theffuel passage 15, the slot 47 is also subjected to this pressure gradient along the circumferential length of thereof.

Thus, the vapor content is effectively removed from the fuel passage 15 longitudinally through the narro slot 47 because the slot 47 defines a substantially straight path along the longitudinal direction but the presence of the narrow slot 47 would not disrupt this pressure gradient along the circumferential direction although it extends a certain distance from its inle port 8*b* into the fuel passage 15 because the narrow slot 47 defines a tortuous path along the circumferential directinn.

Furthermore, since the vapor is removed from the fuelbbefore it is compressed to any significant extent as it travels into the fuel passage 15, the loss of efficiency due to the compression of the vapor and subsequent release thereof is prevented.

Figure 6:
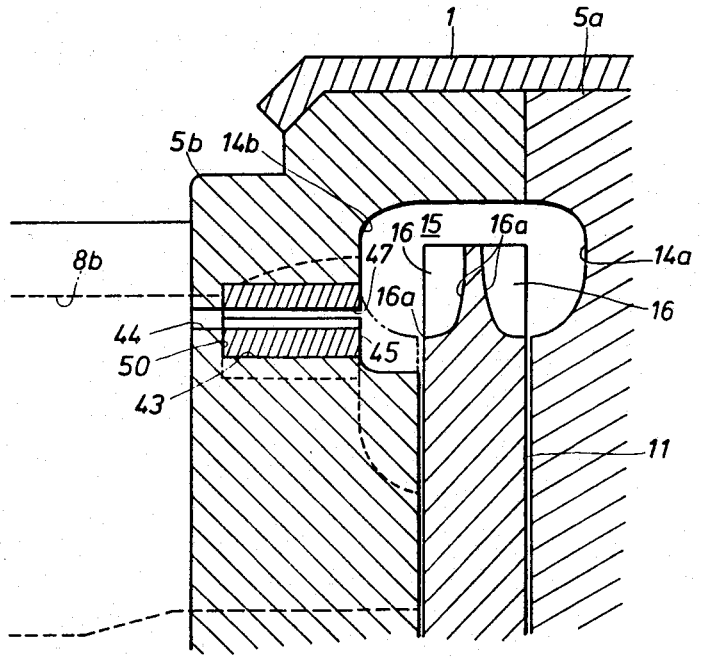
FIG. 6 is a view similar to FIG. 4 showing a second embodiment of the the present invention.

FIG. 6 shows another embodiment of the present invention in which the recess 43 does not extends to the exterior of the pump housing outer half 5*b* and stops short of the external surface of the pump housing outer half 5*b*. In this embodiment, the narrow slot 47 communicates with the exterior of the pump housing outer half 5*b* by way of a small hole 44 which extends longitudinally from a point adjacent to the rear most end or the downstream end of the narrow slot 47. Thus, the labyrinth member 45 is received by a shoulder surface 50 defined at the interface between the recess 43 and the small hole 44 and is thereby securely held in the recess 43. Alternatively, the small hole 44 may be defined in a member, other than the pump housing outer half 5*b*, which may be fitted into the pump housing outer half 5*b* as long as the small hole is defined adjacent to the rear most end of the narrow slot 47. Further, the small hole 44 may be replaced with a slit which extends along the fuel passage 15.

Figure 5:
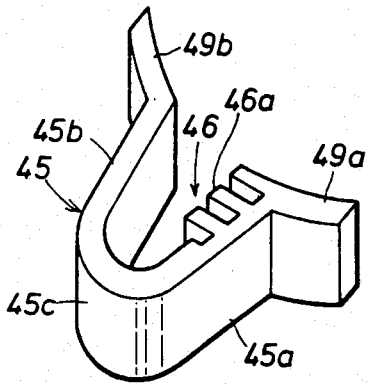
FIG. 5 is a magnified perspective view of the labyrinth member.
Figure 7:
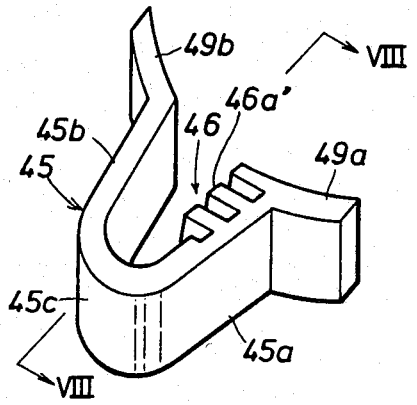
FIG. 7 is a view similar to FIG. 5 showing an alternate embodiment of the labyrinth member.
Figure 8:
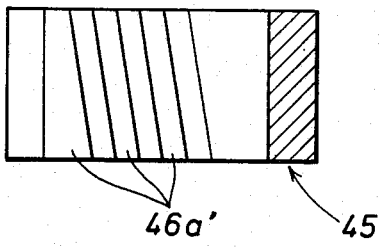
FIG. 8 is a sectional view taken along line VIII—VIII of FIG. 7.

FIGS. 7 and 8 show an alternate embodiment of the labyrinth member 45 which is similar to the one shown in FIG. 5 but is provided with ridges 46*a*′ extending obliquely in relation with the longitudinal direction of the fuel pump. Thus, the effective length of the longitudinal path defined by the labyrinth member 45 is increased and this is helpful in adjusting the optimum flow resistance against the flow of fuel vapor. As a matter of fact, because the labyrinth members 45 shown in FIGS. 5 and 7 can be readily replaced, their optimum configurations can be experimentally determined without any difficulty.

Thus, in any one of the above-described embodiments, the aapor which may be contained in the fuel is favorably removed in the longitudinal direction through the narrow slot 47 and a pressure gradient along the fuel passage 15 is maintained in spite of the presence of the arrow slot because the narrow slot 47 is tortuous along the direction of the fuel passage 15. Furthermore, the narrow slot 47 extends from the inlet port 8*b* into the fuel passage 15 and the vapor is, therefore, favorably removed before it is substantially compressed. These two factors assures the high efficiency of the pump in spite of the provision of the narrow slot 47 for removing the vapor. Thus, the present invention is of a high practical value because it can efficiently remove vapor from the fuel without causing any substantially loss in the pump efficiency.

Although the present invention has been shown and described with reeerence to the preferred embodiments thereof, it should not be considered as limited thereby. Various possible modificationsaand alterations could be conceived of by one skilled in the art to any particular embodiment, without departing from the spirit and scope of the invention.

What we claim is:

1. A regenerative fuel pump, comprising:

a pump rotor having a plurality of vanes along its periphery;

a pump housing accommodating the pump rotor in a rotatable manner;

a fluid inlet port provided in the pump housing along a longitudinal directinn;

an arcuate fuel passage extending in the pump housing from the inlet port along the periphery of the pump rotor;

a fluid outlet port communicating with a terminal end of the arcuate fuel passage; and a slot extending from the inlet port a certain distance into the arcuate fuel passage along an inner circumferential region thereof;

the slot extending longitudinally from the arcuate fuel passage to pump exterior through a substantially narrow path and circumferentially through a tortuous path.

2. A regenerative fuel pump as defined in claim 1, wherein the slot is defined by a U-shaped member which is fitted into a recess provided in the pump housing.

3. A regenerative fuel pump as defined in claim 2, wherein the U-shaped member is provided with a pair o legs which define the slot therebetween, at least one of inner surfaces of the legs being provided with a shape of battlement so as to define the circumferential tortuous path.

4. A regenerative fuel pump as defined in claim 3, wherein the U-shaped member is provided with a pair of flanges at end portions of the legs of the U-shaped member, the flanges defining a part of a wall surface of the inlet port of the pump.

5. A regenerative fuel pump as defined in claim 3, wherein the battlement defines a plurality of straight longitudinal ridges.

6. A regenerative fuel pump as defined in claim 3, wherein the battlement defines a plurality of longitudinal ridges direction of the fuel pump.

7. A regenerative fuel pump as defined in claim 2, wherein the recess extends from the arcuate fuel passage to the pump exterior.

8. A regenerative fuel pump as defined in claim 2, wherein the recess extends short of the pump exterior and a hole extends from the recess to the pump exterior, a shoulder surface being defined between the hole and the recess for receiving the U-shaped member.

* * * * *

UNITED STATES PATENT AND TRADEMARK OFFICE

CERTIFICATE OF CORRECTION

PATENT NO. : 4,793,766

DATED : 12/27/88

INVENTOR(S) : Hirotaka Kumata

It is certified that error appears in the above-identified patent and that said Letters Patent is hereby corrected as shown below:

Column 1, line 32, delete "alnng" and insert --along--.

Column 1, line 40, delete "oute" and insert --outer--.

Column 1, line 44 delete "fuelppassage" and insert -- fuel passage--.

Column 1, line 46 delete "centrifgal" and insert --centrifugal--.

Column 2, line 5 delete "thearcuate" and insert --the arcuate--.

Column 2, line 20 delete "rrocess" and insert --process--.

Column 2, line 42 delete "totthe" and insert --to the--.

Column 2, line 52 delete "magnifie" and insert --magnified--.

UNITED STATES PATENT AND TRADEMARK OFFICE

CERTIFICATE OF CORRECTION

PATENT NO. : 4,793,766

DATED : December 27, 1988

INVENTOR(S) : Hirotaka Kumata

It is certified that error appears in the above-identified patent and that said Letters Patent is hereby corrected as shown below:

Column 3, line 6, delete "pumphhousing" and insert --pump housing--.

Column 4, line 13, delete "outeet" and insert --outlet--.

Column 4, line 21 delete "cylondrical" and insert --cylindrical--.

Column 4, line 38 delete the period.

Column 4, line 39 delete "aD-shaped" and insert --a D-shaped--.

Column 5, line 25 delete "theffuel" and insert --the fuel--.

Column 5, line 29 delete "narro" and insert --narrow--.

Column 5, line 25 delete "directinn" and insert --direction--.

Column 5, line 38, delete "fuelbbefore" and insert --fuel before--.

UNITED STATES PATENT AND TRADEMARK OFFICE

CERTIFICATE OF CORRECTION

PATENT NO. : 4,793,766

DATED : December 27, 1988

INVENTOR(S) : Hirotaka Kumata

It is certified that error appears in the above-identified patent and that said Letters Patent is hereby corrected as shown below:

Column 6, line 6 delete "aapor" and insert --vapor--.

Column 6, line 10 delete "arrow" and insert --narrow--.

Column 6, line 22 delete "reeerence" and insert --reference--.

Column 6, line 24 delete "modificationsaand" and insert --modifications and--.

Column 6, line 35 delete "directinn" and insert --direction--.

Column 6, line 53 after "pair" delete "o" and insert --of--.

Column 6, line 68 after "ridges" insert --which are inclined in relation with the longitudinal--.

Signed and Sealed this

Seventh Day of April, 1992

*Attest:*

HARRY F. MANBECK, JR.

*Attesting Officer*

*Commissioner of Patents and Trademarks*